US006104005A

United States Patent [19]

Adamski et al.

[11] Patent Number: 6,104,005

[45] Date of Patent: Aug. 15, 2000

[54] ELECTRIC HEATING ELEMENT FOR COOKING OVEN

[75] Inventors: Joseph R. Adamski, Pasadena; Joey J. Kitabayashi, La Mirada; Wouter J. Wiersma, Arcadia, all of Calif.

[73] Assignee: Distinctive Appliances, Inc., Pasadena, Calif.

[21] Appl. No.: 09/289,352

[22] Filed: Apr. 9, 1999

[51] Int. Cl.[7] ..... A21B 1/22; F27D 11/02

[52] U.S. Cl. ..... 219/409; 219/538

[58] Field of Search ..... 219/408, 409, 219/538, 552, 553, 410, 411

[56] References Cited

U.S. PATENT DOCUMENTS 2,872,558 2/1959 Price ..... 219/409

FOREIGN PATENT DOCUMENTS 158851 3/1957 Sweden ..... 219/409

*Primary Examiner*—Joseph Pelham
*Attorney, Agent, or Firm*—Lyon & Lyon LLP

[57] ABSTRACT

An electric heating element for the bottom of a cooking oven. The heating element has a unique shape or pattern in plan view that includes two narrow loops or arms extending toward the rear corners of the oven and two wider loops or arms extending toward the front corners of the oven with the narrow loops joined to the wider loops by concave side portions and the two wider loops joined in the front by a concave portion. The extremities of the four loops are closely spaced from the rear wall and two walls of the oven. This shape and size creates more uniform heating throughout the oven cavity than conventional heating elements of different shapes or patterns.

16 Claims, 3 Drawing Sheets

ELECTRIC HEATING ELEMENT FOR COOKING OVEN

The present invention relates to electric cooking ovens and, in particular, to the shape of the electric heating element positioned at the bottom of the cooking oven.

Electric cooking ovens are provided with an electric heating element near the bottom floor of the oven for warming and baking food and other items in the oven. The bottom heating element is comprised of an electrically resistive element in the form of a rod that is bent to a shape to extend along and parallel to the bottom floor of the oven. The shape of the bottom heating element may be a simple square or rectangle to encircle the bottom floor of the oven near the walls or a complex curved shape to provide a longer length of heating element rod. It is desirable that the temperature in the oven be relatively uniform throughout the entire oven for even cooking of the goods regardless of the location of the goods in the oven cavity from top to bottom, side to side and front to back, but it has been found that there are substantial variations in the temperature throughout the oven cavity in an electric oven, which causes uneven cooking. Also, this lack of uniformity of temperature creates a difficulty in controlling the temperature in the oven because the permanent temperature probe for the oven thermostat may be located in the oven cavity at a position that is at a substantially different temperature than other portions of the oven cavity. Moreover, the location of the thermostat temperature probe is somewhat limited because it cannot interfere with the racks, trays, pans or food that are placed in the oven even though it might be desirable to have the temperature probe at precisely the location of the food that is being cooked.

It is an object of the present invention to provide an electric heating element of a unique shape to fit in the bottom of a cooking oven and provide substantially uniform heating throughout the oven cavity. To accomplish this objective, the unique heating element is provided with loop portions extending toward each corner of the bottom floor of the oven with an open middle area to provide the uniform heating throughout the heating cavity without creating high temperature areas, such as in the middle of the oven.

Other and more detailed objects and advantages of the present invention will be apparent to those skilled in the art from the detailed description of the invention and the accompanying drawings, wherein.

Figure 1:
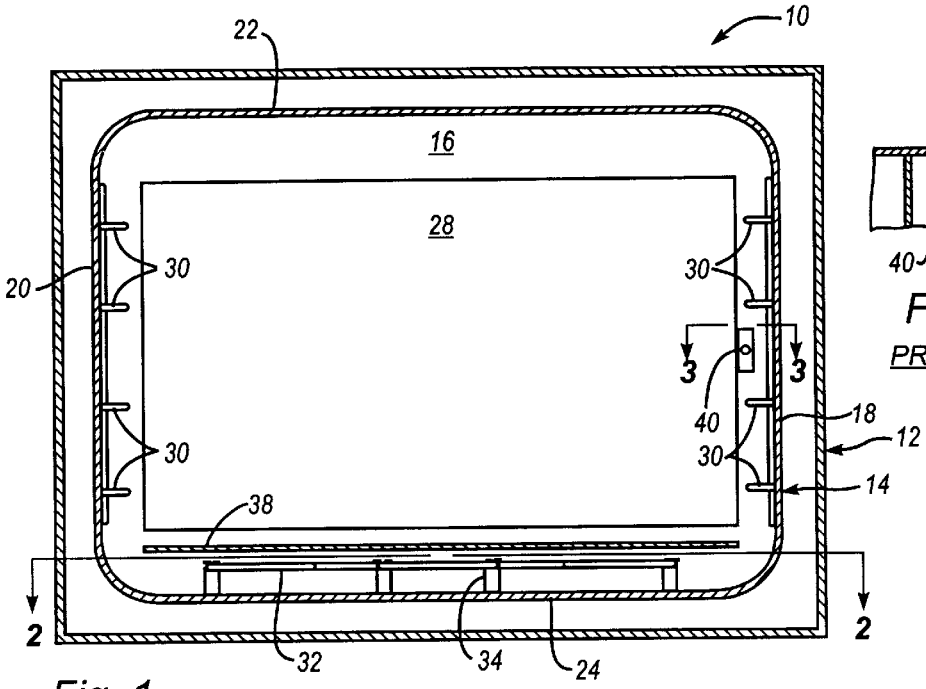
Fig. 1 PRIOR ART
FIG. 1 is a front sectional elevation view of a conventional cooking oven taken substantially on the line 1—1 of FIG. 2.
Figure 3:
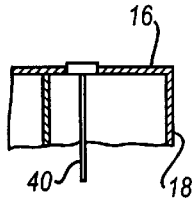
Fig. 3 PRIOR ART
FIG. 3 is a fragmentary sectional plan view taken substantially on line 3—3 of FIG. 1 and illustrating a typical temperature probe for the oven thermostat.
Figure 2:
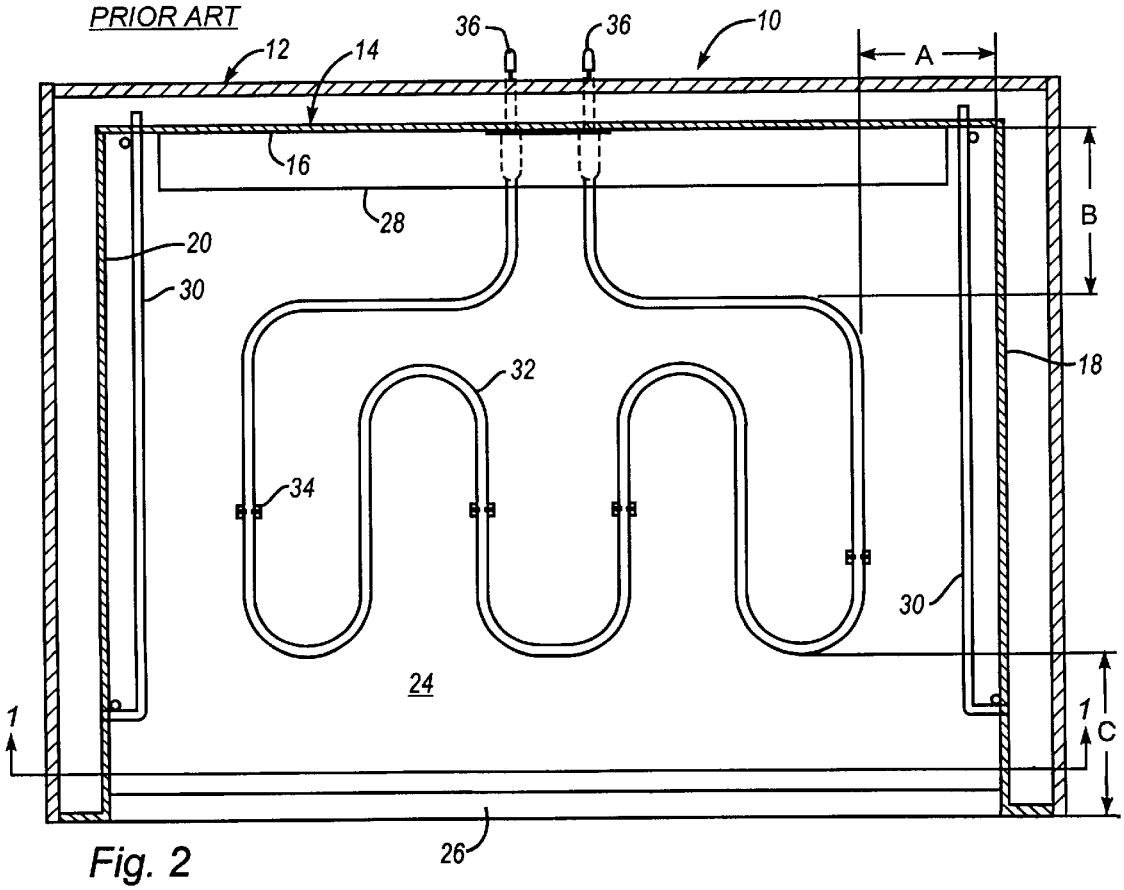
Fig. 2 PRIOR ART
FIG. 2 is a sectional plan view of a conventional cooking oven taken substantially on line 2—2 of FIG. 1 and illustrating a typical bottom electric heating element.

Referring now to FIGS. 1–3 that diagrammatically illustrate a conventional cooking oven with a conventional bottom heating element, the cooking oven 10 has an outer housing 12 and an inner shell 14 forming the oven cavity, with insulation filling the space between the outer housing 12 and inner shell 14, or the outer housing 12 may be omitted for some types of installation. The inner shell 14 has a rear wall 16, a right side wall 18, a left side wall 20, a top wall 22, a bottom wall 24 and a front opening 26. A door (not shown for clarity of illustration) is provided in the front opening 26. A convection heating apparatus 28 may be provided on the rear wall and a broiler element (not shown) may be provided on the top wall 22, but a detailed description of such devices is not relevant to the present invention. A conventional plurality of rods 30 are provided on each side wall 18 and 20 for supporting racks (not shown) in the oven 10 for in turn supporting the pans and food items.

Typically, a bottom electric heating element 32 is supported on the bottom wall 24 by a plurality of ceramic posts 34 and has a pair of electrical connectors 36 extending into an electrical socket (not shown) in the rear of the oven. The bottom heating element 32 may be positioned below a floor 38 or the floor may be omitted. The heating element 32 illustrated in FIG. 2 is a typical shape that is often referred to as a "cactus" shape that curves back and forth parallel to the bottom wall 24 of the oven shell 14 and such a shape allows for a substantial length of heating element to be provided for rapid heating of the oven, as well as providing the appearance of well distributed heating throughout the bottom of the oven shell. However, it has been found that with the cactus shaped bottom heating element 32 and other conventional bottom heating element shapes that a temperature differential occurs from one location in the oven to another of up to 60° F. at normal baking temperatures. Specifically, it has been found that the temperature in the center of the inner shell 14 can be 60° F. higher than at the temperature probe 40 in a typical location at the back right corner of the oven. Thus, for a given setting of the oven thermostat, the center of the oven may be 60° F. higher than the temperature sensed by the thermostat probe 40, and similar variations in temperature occur throughout the oven cavity which precludes uniform heating of the food items being cooked.

For purposes of a subsequent comparison herein, the typical spacing of the conventional bottom heating element 32 from the walls and front of the oven 10 are shown in FIG. 2 by the dimensions A, B and C. The spacing A of the element 32 from the side wall 18 is approximately 4 inches, the spacing B of the major portion of the element 32 from the back wall 16 is approximately 5 inches, and the spacing of the front of the element 32 to the front opening 26 of the oven is approximately 5 inches. While these spacing dimensions may be somewhat different with different shapes of bottom heating elements, it is relatively conventional to provide a substantial space between the heating element and the rear wall, side walls and front opening.

Figure 4:
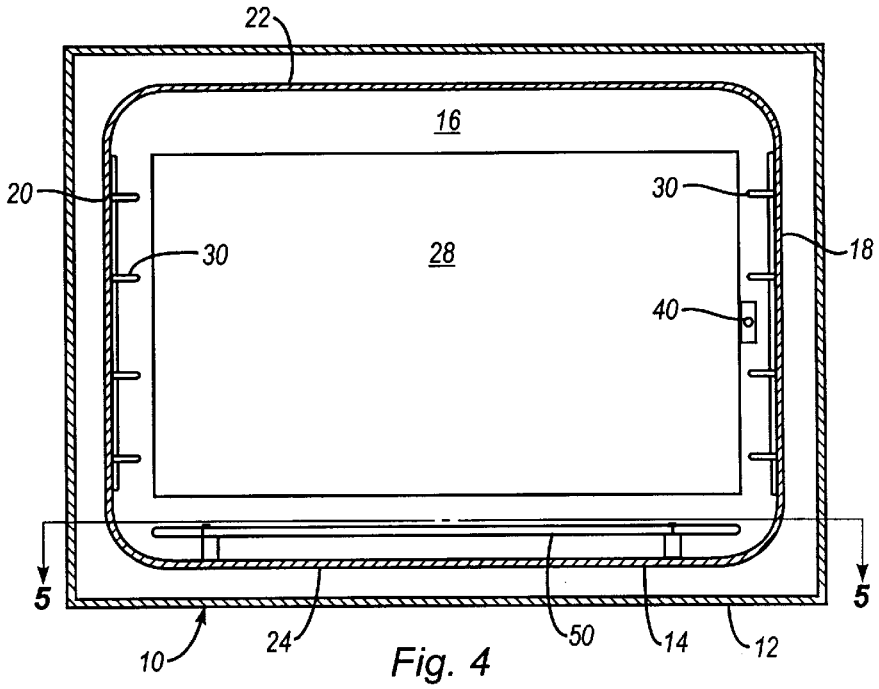
FIG. 4 is a front sectional elevation view similar to FIG. 1 taken substantially on the line 4—4 of FIG. 5 and illustrating the bottom electric heating element of the present invention.
Figure 5:
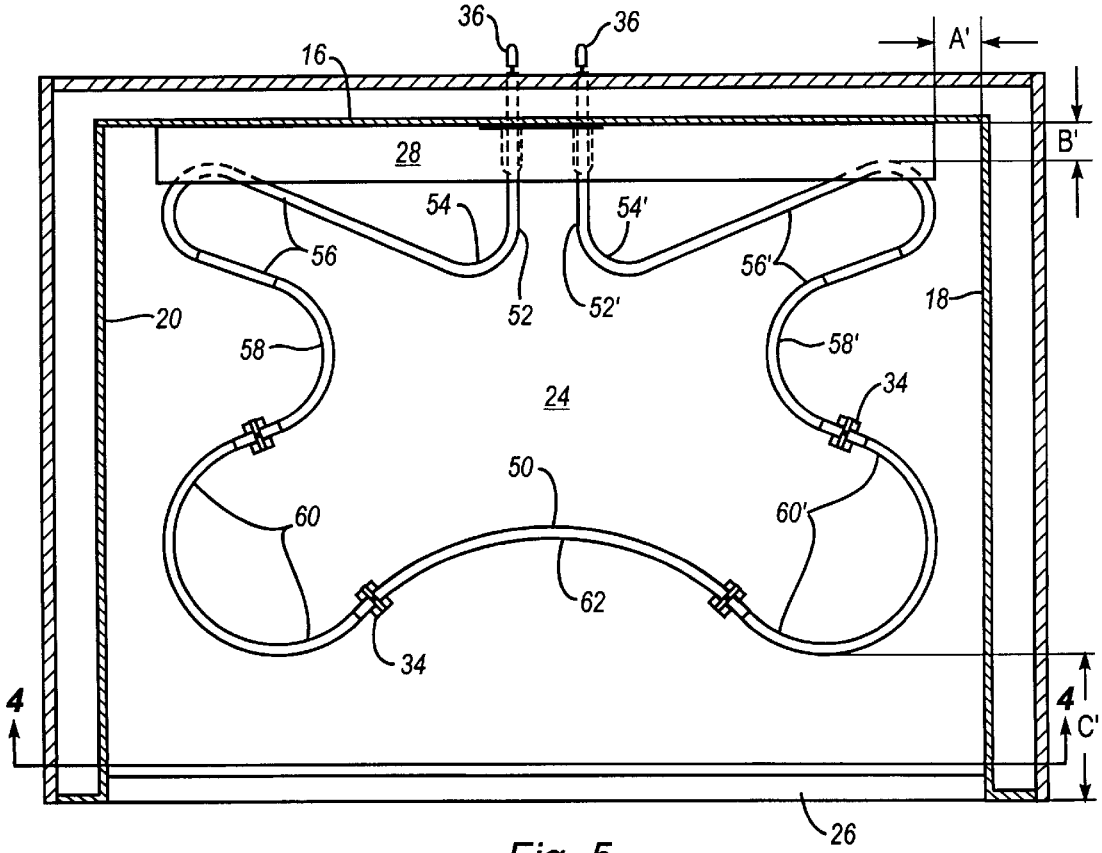
FIG. 5 is a sectional plan view similar to FIG. 2 taken substantially on line 5—5 of FIG. 4 and illustrating the unique bottom heating element of the present invention.

Referring now to FIGS. 4 and 5, the unique shape of the bottom electric heating element 50 of the present invention is illustrated as mounted in a conventional oven 10 that, for comparison, is identical to the oven illustrated in FIGS. 1–3, except for the differences in the shapes of the bottom heating elements 32 and 50. Again, the cooking oven 10 is provided with an outer housing 12 that encircles an inner shell 14 which has a rear wall 16, right side wall 18, left side wall 20, top wall 22, bottom wall 24, open front 26, convection heating apparatus 28, multiple rods 30 on both side walls for supporting racks in the oven, and a temperature probe 40. With the heating element 50 of this invention, it is preferred that the floor 38 shown in FIG. 1 be omitted which improves the speed with which the oven is heated from room temperature to the desired temperature and, with this invention, the absence of the floor 38 does not adversely affect the uniformity of the temperature throughout the oven cavity. The heating element 50 also is provided with a plurality of ceramic posts 34 for supporting the heating element on the bottom wall 24. The heating element 50 is also provided with two electrical connections 36 extending rearwardly for electrical connection to a power source socket (not shown).

The bottom heating element 50 of this invention has a unique shape and dimensions that create a uniform heating of the entire oven cavity. Tests have indicated a temperature differential between the probe 40 and the center of the oven cavity to be as low as only one degree Fahrenheit (1° F.), although some earlier tests occasionally showed a temperature differential of up to 10° F., all of such tests but still show a far more uniform temperature distribution than the 60° F. temperature differential measured in the conventional cooking oven of FIGS. 1–3. The shapes left and right sides of the heating element 50 are symmetrical and, therefore, will be described simultaneously. The heating element 50 has two parallel leg portions 52 and 52' (the prime on each number will indicate the portion of the heating element 50 to the right of center) extending inwardly (forwardly) from the electrical connection ends 36. The heating element then bends at a corner 54, 54' outwardly and rearwardly from the center of the oven and back to form a narrow loop or U-shaped arm 56, 56' that extends toward each rear corner formed by the rear wall 16 and each side wall 18, 20 and that narrow loop or arm is closely spaced from the rear wall and respective side walls. The narrow loops 56, 56' of the heating element 50 are then joined to a concave curved portion 58, 58' extending forwardly and then outwardly toward the side walls. The concave curved portions 58, 58' are connected to a wide loop or U-shaped arm 60, 60' that extends generally toward the each front corner formed by the open front 26 and each side wall 18,20. Each wide loop 60, 60' is closely spaced from the respective side wall but is spaced a substantial distance from the front opening 26. The left wide loop 60 and the right wide loop 60' are then joined by a front concave curved portion 62 which is spaced even further from the front opening 26 than the forward-most portions of the wide loops 60, 60'.

The bottom electric heating element 50 of this invention has its extremities more closely spaced from the rear wall and the side walls than conventional bottom electric heating elements, such as heating element 32 shown in FIG. 1, which is believed to contribute to the uniformity of the heat developed throughout the oven cavity. Specifically, for example, the distance A' between the side wall and heating element 50 is only about 1.3 inches as compared to a distance A of about 4 inches for the conventional heating element 32 shown in FIG. 2. Similarly, the distance B' between the rear wall 16 and the heating element 50 is only about one inch as compared to the distance B of about 5 inches for the conventional heating element 32. The distance C' from the front opening 26 of the oven is about 4.3 inches which is only slightly less than the dimension C of about 5 inches for the conventional heating element 32 but it should also be noted that the central, concave curved portion 62 of heating element 50 is spaced substantially farther (about an additional 3.5" to 4") from the front opening 26 than is the central portion of the cactus shaped heating element 32. This substantial spacing of the central portion 62 from the front greatly enhances the ability of this heating element 50 to reduce the risk of a pot holder or towel being burned during the use thereof to pull out a rack, which is a safety test performed by Underwriter's Laboratories known as the "fabric ignition test" wherein six layers of terry cloth are used to pull out the bottom rack and must not be ignited to pass the test.

Figure 6:
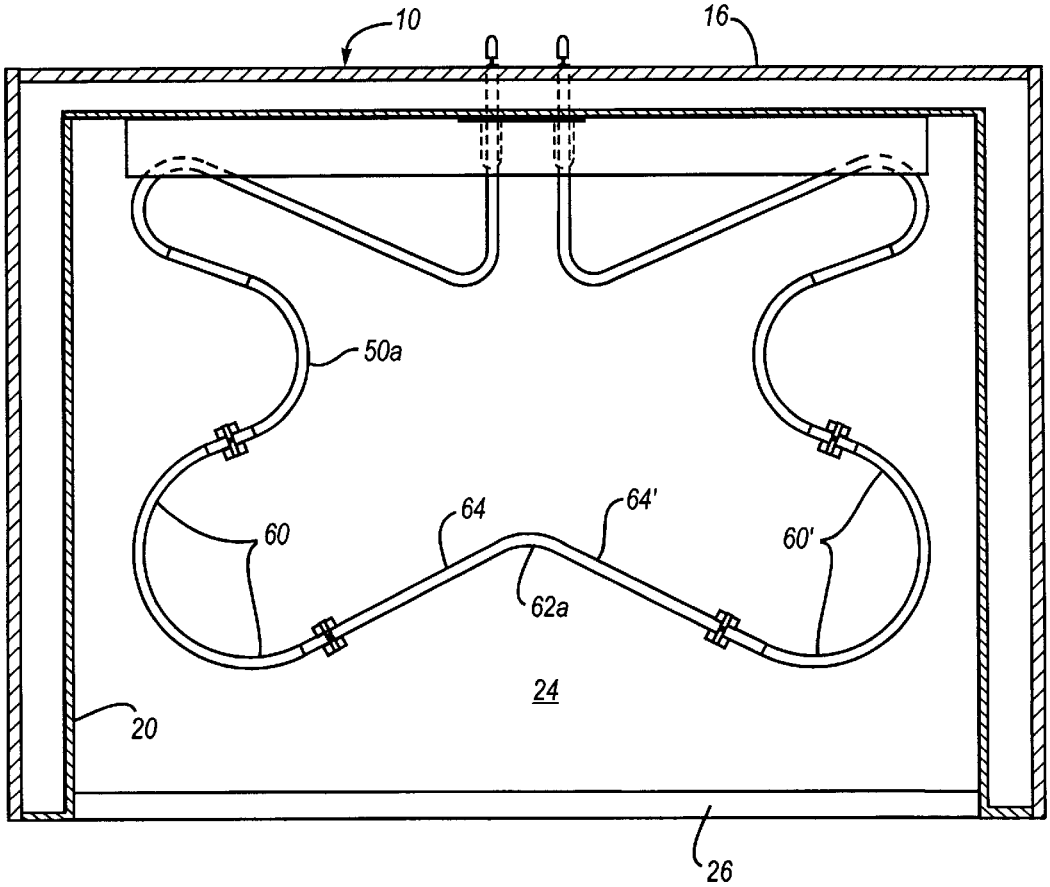
FIG. 6 is a sectional plan view similar to FIG. 5 but illustrating a modified form of the unique bottom electric heating element of the present invention.

Referring now to FIG. 6, a modified form of a bottom electric heating element **50*a* is shown wherein the only difference between the element 50*a* and previously described heating element 50 is in the area of the front concave curve 62*a* and the manner in which it joins with the wide loops (U-shaped arms) 60 and 60'. Specifically, in the heating element 50*a*, a straight section 64, 64' extends between each wide loop 60, 60' and the front concave curved portion 62*a*, which curved portion is substantially shorter than curved portion 62 of heating element 50**.

The bottom electric heating elements **50, 50*a* provide more uniform heating throughout the oven cavity for more uniform cooking and it is believed that this is the result of one or more characteristics or factors of the shape and/or size. One factor may be that the narrow loops 56, 56' extend into close proximity of the rear corners formed by the rear wall 16 and side walls 18, 20 whereby such corners that are normally cooler than the middle of the oven are now adequately heated and, therefore, the temperature probe 40 that is normally and conveniently located in such corners will more accurately respond to the temperature of the entire oven. Another factor may be that the parallel portions 52, 52' extend sufficiently forward before reaching the curves 54, 54' to prevent excessive heat along the rear wall 16 on both sides of the center portion. Still another factor may be the side concave curved portions 58, 58' that are spaced a substantial distance from the side walls to both prevent excessive heating at the central portions of the side wall and to contribute heating toward the center of the oven. Still another factor may be the provision of the wide loops 60, 60' that closely approach the side walls toward the front corners but the width of the loops is sufficiently large to avoid a concentration of heat from the element. Still another factor may be the substantial spacing of the front concave curved portion 62, 62*a* from the front opening 26 to avoid excessive heating of the front portion of the oven and yet to provide heating toward the center of the oven. Still another factor may be that no portion of the bottom electric heating element 50, 50*a* is located at or near the center of the bottom wall 24 of the oven and, therefore, excessive heat is not generated in the center of the oven which would produce the substantial temperature differentials that have been measured with conventional heating elements, such as the cactus-shaped element 32 shown in FIG. 2. It should be noted that the heating elements 50, 50*a* are symmetrical from right to left but asymmetrical from front to back, particularly with respect to the respective widths of the narrow loops 56, 56' and the wide loops 60, 60'**. Other similar shapes that include one or more of the aforementioned factors may adequately accomplish the desired uniform heating of the oven cavity and, therefore, are within the scope of the present invention as defined by the following claims.

What is claimed is:

1. An electric heating element for the bottom of a cooking oven that has a rear wall, a right side wall, a left side wall, a top wall, a bottom wall and a front opening for a door, side electric heating element comprising:

a continuous electrically conductive element having two ends for plugging into an electrical connection socket and being shaped for extending along the bottom wall of the oven in a pattern between said two ends;

said pattern including four-U-shaped arm portions extending from a central portion of the bottom wall toward the four corners, respectively, formed by the rear wall, the two side walls and the front opening, wherein the two said U-shaped arm portions that extend toward the two corners formed at the rear wall are narrower than the other two said U-shaped arm portions.

2. The electric heating element of claim 1, wherein said pattern includes an open central portion from which said four U-shaped portions radiate.

3. The electric heating element of claim 1, wherein said two ends are located at a central base portion of the rear wall.

4. The electric heating element of claim 1, wherein the two said U-shaped arm portions that extend toward the two corners formed at the front opening are connected by a concave curved portion that is spaced from the front opening a larger distance than said two U-shaped arm portions joined thereby.

5. The electric heating element of claim 4, wherein said element includes straight portions connecting said concave curved portion to said two U-shaped arm portions joined thereby.

6. The electric heating element of claim 1, wherein each said U-shaped arm portion is closely spaced from the side wall toward which it extends.

7. The electric heating element of claim 6, wherein said spacing from the side wall is about 1".

8. The electric heating element of claim 1, wherein each of the two said U-shaped arm portions that extend toward the two corners formed by the rear wall are closely spaced from the rear wall.

9. The electric heating element of claim 8, wherein said spacing from the rear wall is about 1".

10. The electric heating element of claim 1, wherein a side concave curved portion connects each of the two pair of said U-shaped arm portions that extend toward the two corners formed by each side wall.

11. The electric heating element of claim 1, wherein the two said U-shaped arm portions that extend toward the two corners formed at the front opening are connected by a concave curved portion that is spaced from the front opening a larger distance than said two U-shaped arm portions joined thereby, and a side concave curved portion connects each of the two pair of said U-shaped arm portions that extend toward the two corners formed by each side wall.

12. The electric heating element of claim 1, wherein said pattern includes an open central portion from which said four U-shaped arm portions radiate, the two said U-shaped arm portions that extend toward the two corners formed at the front opening are connected by a concave curved portion that is spaced from the front opening a larger distance than said two U-shaped arm portions joined thereby, and said element includes straight portions connecting said concave curved portion to said two U-shaped arm portions joined thereby.

13. The electric heating element of claim 12, wherein each said U-shaped arm portion is closely spaced from the side wall toward which it extends, and each of the two said U-shaped arm portions that extend toward the two corners formed by the rear wall are closely spaced from the rear wall.

14. An electric heating element for the bottom of a cooking oven that has a rear wall, a right side wall, a left side wall, a top wall, a bottom wall and a front opening for a door, said electric heating element comprising:

a continuous electrically conductive element having two ends for plugging into an electrical connection socket at a central base portion of the rear wall;

said conductive element being shaped for extending along the bottom wall of the oven in a pattern between said two ends;

said pattern including substantially parallel legs extending forwardly from said two ends, a narrow loop extending from each said leg toward and close to a rear corner formed by the rear wall and each side wall and then away from the rear corner toward a central portion of the bottom wall, a side concave curve curving forwardly and then outwardly toward the side wall from each narrow loop, a wide loop extending from each side concave curve toward a front corner formed by the front opening and each side wall and then away from the front corner toward said central portion of the bottom wall, each said wide loop closely spaced from a side wall, and a front concave curve joining said wide loops at a location spaced further from the front opening than a forwardmost portion of each of said wide loops.

15. The electric heating element of claim 14, wherein said pattern is symmetrical from a center of the bottom wall toward the right and left side walls and asymmetrical from said center toward the rear wall and the front opening.

16. The electric heating element of claim 14, wherein said spacing from the side wall is about 1", and said spacing from the rear wall is about 1".

* * * * *